US005409231A

United States Patent [19]

Kueng et al.

[11] Patent Number: 5,409,231

[45] Date of Patent: Apr. 25, 1995

[54] GOLF PUTTING TRAINER

[76] Inventors: Jeffrey S. Kueng; Cynthia M. Kueng, both of 2731 Mackubin St. 17, Roseville, Minn. 55113

[21] Appl. No.: 170,067

[22] Filed: Dec. 20, 1993

[51] Int. Cl.[6] ..... A63B 69/36

[52] U.S. Cl. ..... 273/176 FB; 273/192; 273/186.1

[58] Field of Search ..... 273/176 F, 162 E, 192, 273/191 R, 187.1, 176 FA, 176 FB, 186.1

[56] References Cited

U.S. PATENT DOCUMENTS

| | | | |
|---|---|---|---|
| 2,894,755 | 7/1959 | Scelzo | 273/192 |
| 3,332,688 | 7/1967 | Gevertz | 273/186.1 |
| 3,779,398 | 12/1973 | Hunter | 273/162 E X |
| 4,344,624 | 8/1982 | Laursen | 273/176 F |
| 4,368,888 | 1/1983 | Ren | 273/176 FB |
| 4,805,912 | 2/1989 | Hickman | 273/176 FA |
| 4,962,933 | 10/1990 | Awazu et al. | 273/186.1 |

*Primary Examiner*—George J. Marlo
*Attorney, Agent, or Firm*—Douglas L. Tschida

[57] ABSTRACT

A putting accuracy training aid providing an elongated, flat rolling surface and a non-slip base. A recessed tee supports a ball forward of an adjustable stroke gauge and elastomer limit stop. Inclined surfaces, projections and/or grooves provided adjacent the tee facilitate re-teeing without stooping. Jointed multi-section constructions are also disclosed having a sectional body and/or wing attachments.

15 Claims, 10 Drawing Sheets

GOLF PUTTING TRAINER

BACKGROUND OF THE INVENTION

The present invention relates to golf training devices and, in particular, to a putting proficiency trainer for indoor practice to develop putting consistency, accuracy and confidence.

A variety of putting devices exist which permit indoor golf practice and particularly putting practice. Depending upon the specific device, each may focus on one or more variables which enter into the putting stroke. These variables can relate to body placement, such as the feet, shoulders, hips and hands in relation to the addressing of the ball. Further variables can relate to the striking force and the alignment and related eye-hand coordination pertaining to the backswing and follow through of the putting stroke.

The related complexity of the assembly varies depending upon the numbers of variables which the device attempts to correct through repetitive practice. Some of such devices provide prepared putting surfaces approximating the granularity of grass, which include practice holes. Some include electronic sensors to provide feedback about the stroke condition. Some mimic the golf hole and provide a target hole which can be placed on a floor surface or in air registers to permit indoor practice. Some provide mirrors or magnetic indicators to assure certain head alignments. Others provide mechanical restraints to maintain arm, wrist and/or hand position to the putter.

Many assemblies also exist to assure a squared alignment of the putter head to the ball during and through the putting stroke motion. Some provide mechanical gauges and mirrors whereby the golfer is able to monitor head motion over the stroke. Some provide a guide surface, which the putter shaft follows to assure an aligned, squared travel motion.

Although a repetitive motion can be practiced with many of the latter devices, a deficiency exists in that the golfer does not have the benefit of the feedback of the ball travel to confirm the proper stroke motion. Consequently, repetitive practice can merely result in a learned stroke, but which does not provide accurate results. Preferably, a training device should permit a normal stroke motion, while allowing the golfer to monitor selected portions of the motion and obtain a feedback of the resultant effect on ball travel. With the exception of artificial hole structures, which can be randomly positioned about a floor, available assemblies do not provide a mechanism which confirms straight line ball travel in relation to a predetermined alignment of the putter head to the ball.

In appreciation of the foregoing shortcomings, the present invention was developed to provide an assembly which allows a golfer to monitor stroke motion during the backswing motion, to assure the putter head is square to the ball, and to confirm a straight line ball travel in relation to an elongated travel path. A controlled, consistent backswing and follow through with corresponding putting accuracy are thereby obtained.

SUMMARY OF THE INVENTION

It is accordingly a primary object of the invention to provide a golf swing training and practice device and particularly a device for improving putting accuracy and consistency.

It is a further object of the invention to provide a planar ball support having a narrow, uninterrupted rolling surface containing indicia indicating distance traversed by the ball, relative to putter-to-trainer alignment and backswing travel.

It is a further object of the invention to provide a training device providing a tee position and means for positioning a ball to the tee without requiring stooping or bending.

It is a further object of the invention to provide a training device including an adjustable, backswing gauge and elastomer limit stop to facilitate a consistent backstroke.

It is a further object of the invention to provide a training device compatible with a variety of indoor floor surfaces to minimize slippage and maintain a horizontally flat rolling surface.

Various of the foregoing objects, advantages and distinctions of the invention are obtained in a presently preferred construction which provides a planar ball support, approximately four feet long and one inch wide, having a hardened rolling surface containing indicia indicative of traveled distance, backswing distance and putter-to-trainer alignment. A recessed tee position supports a golf ball to permit a true ball release and roll, without bounce. Milled surfaces formed into the trainer body provide a true tee ball support, which doesn't affect ball roll, and which direct each new ball to the tee position without requiring stooping.

A slotted channel cut into the body aft of the tee position supports an adjustable bumper or limit stop in relation to backswing measurement indicia. Upon appropriately positioning the limit bumper, a defined backswing is obtained. An elastomer covering bound to the bottom of the trainer assures a non-slip interface with a support surface, typically a floor covering.

Still other objects, advantages and distinctions of the invention will become more apparent upon reference to the following description with respect to the appended drawings. To the extent various modifications and improvements have been considered, they are described as appropriate. The scope of the invention should not be strictly construed to the provided description, which is illustrative only of the presently considered constructions of the invention. Rather, the invention should be interpreted within the scope of the appended claims.

DESCRIPTION OF THE PREFERRED EMBODIMENT

Figure 1:
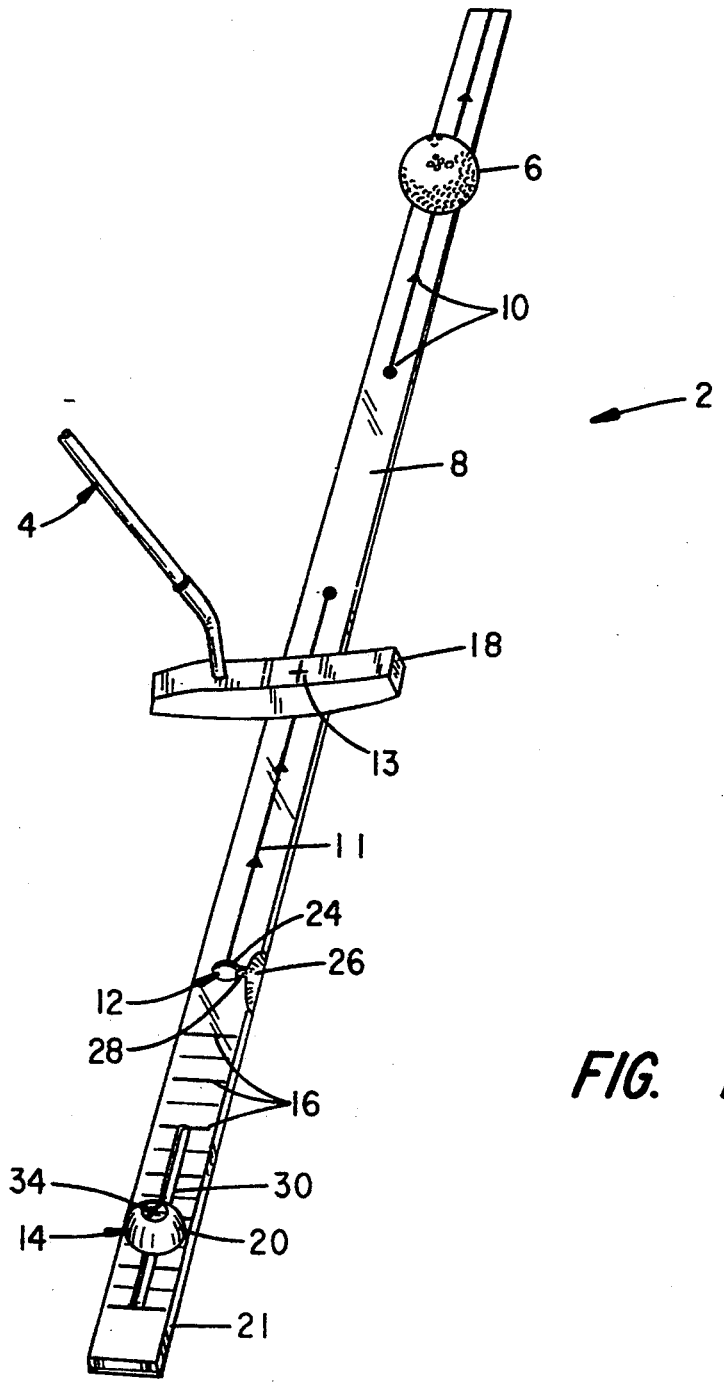
FIG. 1 is a perspective drawing of the inventive putting trainer as it appears in normal use.

Referring to FIG. 1, a perspective view is shown of the golf swing trainer 2 of the invention in relation to a golf club 4 and a ball 6 and as the trainer 2 might appear in typical use. The trainer 2 provides a training device for use by a golfer to develop a consistently accurate putting stroke with a controlled backswing. Accuracy is confirmed through visual feedback obtained from monitoring ball travel along a flat, rolling surface 8 in relation to indicia 10 indicative of traversed distance. Proficiency is confirmed with increasing roll time and distance along the surface 8.

In normal use, the trainer 2 is typically supported on an indoor, covered floor surface. The floor cover may comprise carpeting, wood, linoleum or tile, etc. To negate surface imperfections and granularity, which can induce bounce and variations in ball roll, the trainer 2 provides an essentially uninterrupted, hard, smooth rolling surface 8. Excepting body position variables, stroke variables are reduced to backswing and the alignment of the putter head 18 to the trainer 2.

Undulations of the floor covering are negated by constructing the trainer 2 to be relatively rigid and stiff. The width of the trainer 2 is also sized to typically assure a flat horizontal rolling surface. Shims (not shown) may be mounted to level or position the trainer 2 at a desired incline, provided the ball 6 is retained to a tee position 12.

The tee position 12 receives and supports a practice ball 6 at one end of the trainer 2, slightly forward of an adjustable backswing stop or putter head travel limit assembly 14. The position of the stop assembly 14 can be adjusted along the trainer 2 in relation to provided backswing indicia 16. Just as forward ball travel is monitorable by way of the indicia 10, backswing travel of the putter head 18 is monitorable at the indicia 16. Inadvertent striking of a rubber stop bumper 20 provides a tactile feedback of an "overswing" condition. Possible slippage of the trainer along the floor covering with overswing is minimized via a cushioned, elastomer covering 21 secured to the bottom surface of the trainer 2.

More of the details of the trainer 2 are apparent at FIGS. 2 through 6, which depict plan and elevation views of the trainer 2. With collective reference thereto, the body 22 of the trainer 2 is formed from a piece of hardened stock material, such as plastic, wood or metal. Presently a semi-transparent acrylic plastic is used. The material is cut to the approximate dimensions of one inch wide, 48 inches long and $\frac{3}{8}$ inches thick. The dimensions and type of material can be altered to provide a shorter, longer, wider or thicker device. Depending upon the normally encountered floor covering surface, the thickness and width provide a flat, horizontal surface. Too wide of a rolling surface is to be avoided. That is, although ball travel distance may increase with a wider trainer, accuracy may not. A narrow trainer 2 requires greater concentration and attention to the details of each stroke, which leads to the development of a consistently accurate putting stroke over typically encountered distances.

Figure 7:
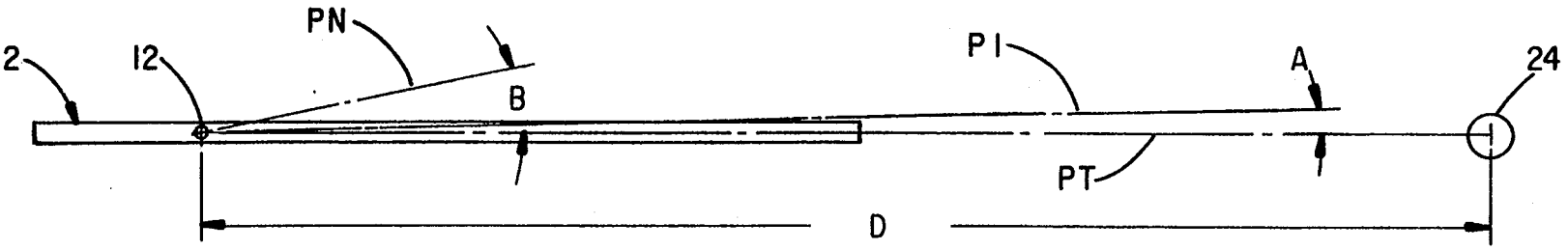
FIG. 7 is a view depicting the geometry pertaining to accuracy through use of the putting trainer.

The geometry of the putting condition is shown at FIG. 7 in relation to the trainer 2 and a typical golf hole 24. A one-inch rolling surface 8 when taken in relation to a 4.25 inch diameter golf hole provides a sufficient lateral rolling surface to accommodate some misalignment, presuming a straight line ball roll, while enabling the hitting of a hole located within a range of approximately 2 to 8 feet. The closer the ball travel path is to the center line of the trainer 2, the higher the probability of achieving longer distance accuracy under playing conditions.

That is, a number of imaginary travel paths PT, Pl and PN are shown at FIG. 7 in relation to a golf cup 24. Depending upon the ball-to-hole distance "D", preferably the travel path of each practice ball falls between the true center path PT and path "Pl" and an angle of ±A. Premature exiting of the ball from the training surface 8, such as by following a travel path "PN" and angle B indicates a missed putt.

The width of the trainer 2 can be varied to permit greater ball travel along the surface 8 before the ball 6 falls from the device 2. While a golfer's ego may be bolstered, the geometries depicted at FIG. 7 demonstrate the golfer's game will not improve, and thus defeat the purpose of the trainer 2. Consequently, a relatively narrow rolling surface 8 is preferred. Depending upon the stroke distance for which one practices, the relatively long length of the trainer 2 provides feedback to putting accuracy for greater distances. Occasionally, however, a wider or longer trainer may be desired and which is discussed at FIG. 10 below.

Figure 2:
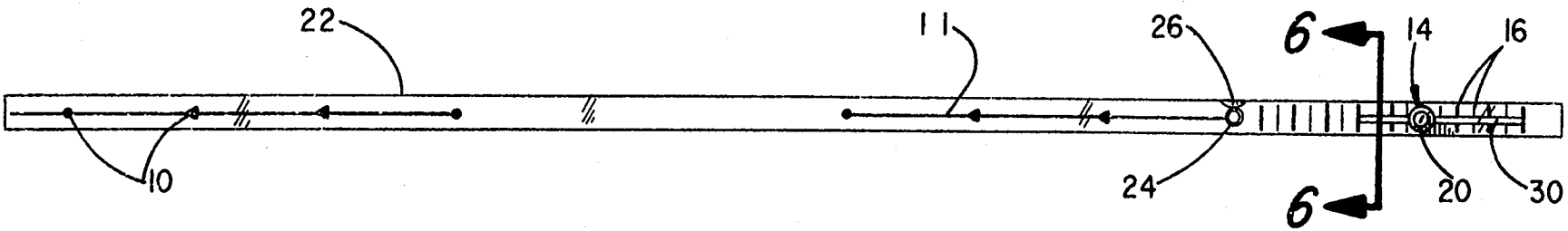
FIG. 2 is a top plan view of the trainer.
Figure 3:
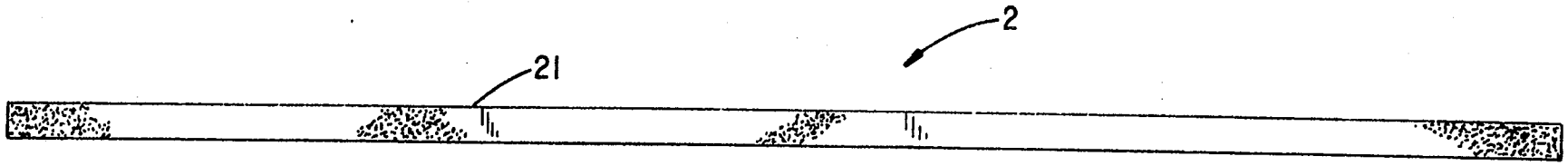
FIG. 3 is a bottom plan view of the trainer.
Figure 4:
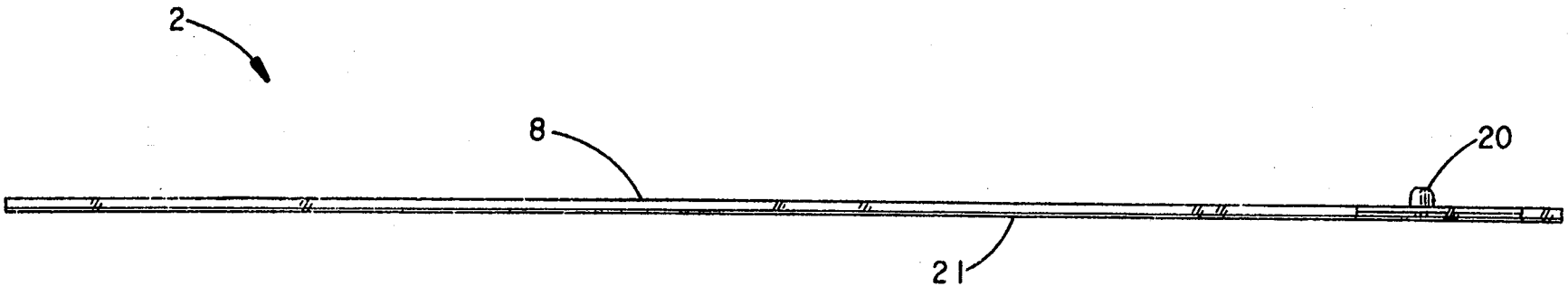
FIG. 4 is a front elevation view of the trainer.
Figure 5:
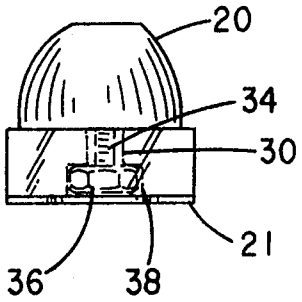
FIG. 5 is an end view of the trainer.
Figure 6:
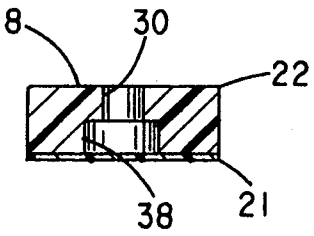
FIG. 6 is a cross section view taken along section lines 6—6 of FIG. 2 and through the backswing gauge assembly.

Returning attention to FIG. 1 and with additional attention to FIGS. 2, 5 and 6, more of the specific details of the tee 12 and backswing stop assembly 14 are apparent. The tee 12 principally comprises an aperture 24 which is cut into the rolling surface 8. The aperture is sized to a diameter sufficient to support and readily locate the ball 6 to the trainer 2, without requiring undue time to locate the ball to the aperture 24, and during which time the ball 6 can roll off the surface 8.

Figure 8:
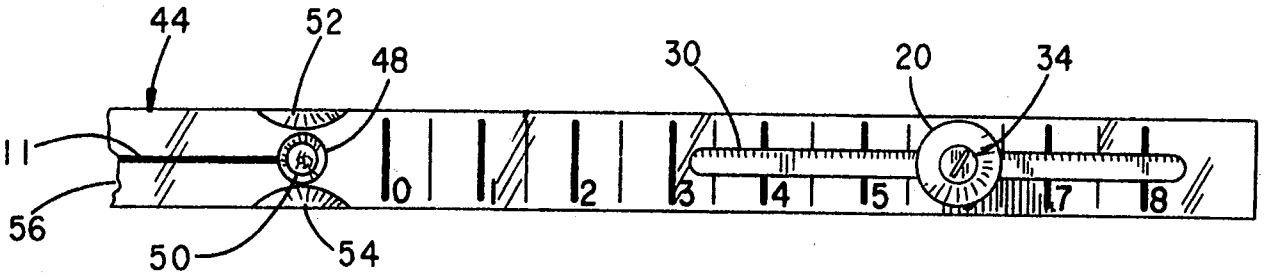
FIG. 8 is a top plan view of an alternative tee position including multiple guide ramps.
Figure 9:
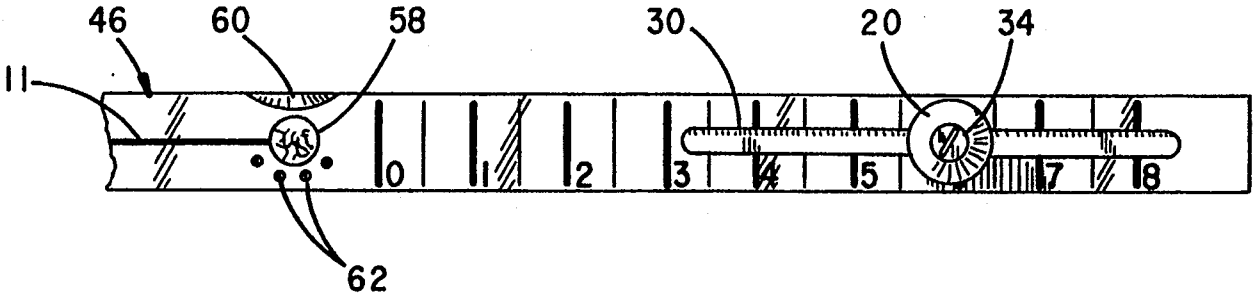
FIG. 9 is a top plan view of an alternative tee position which includes formed surface projections to guide ball placement.

The aperture 24 preferably is sized and shaped to provide a smooth release to the ball 6 without inducing a bouncing action or other roll effecting aberrations. Although a circular aperture 24 is presently preferred, it is to be appreciated recesses of other shapes or alternatively raised surface protrusions can be formed into the surface 8 to provide a proper teeing action. FIGS. 8 and 9, which are described below, depict two alternative tee arrangements.

Cut into the body 22 adjacent the tee 12 is an inclined or ramp surface 26. The ramp 26 is formed to an arcuate shape and permits a golfer to direct the ball 6 from the surface 26 with the putter head 18 and, with a slight lifting action, raise the ball onto the surface 8 and to the tee 12. The inclination and shape of the surface 26 can be varied to facilitate ball location. In that regard, a groove 28 might couple the surface 26 to the aperture 24 to guide the ball.

A slot 30 is cut into the body 22 approximately four inches behind the tee 12. The slot 30 extends approximately five inches and permits a selective positioning of the rubber bumper 20 along the slot 30 in relation to the indicia 16. The desired position of the bumper 20 is fixed upon rotating a threaded member 34 which extends from the bumper 20 to a threaded nut fastener 36. The nut 36 mounts within a slotted channel 38 that communicates with the channel 30. The elastomer, covering 21 covers the slot 38 and retains the fastener 36 within the slot 38, should the fastener 34 inadvertently be released from the nut 36.

Upon positioning the bumper 20, a golfer is reminded of an overswing condition, if the bumper 20 is struck during normal swing motion. Preferably, the golfer will not strike the bumper 20; although if slightly struck, the gripping surface of the covering 21 stabilizes the trainer 2 to prevent premature release of the ball from the tee 12.

In normal use, a golfer monitors his/her backswing at the indicia 16 to prevent striking the bumper 20 and to confirm a desired backswing displacement. With practice time and increasing proficiency, the golfer tends to develop an innate feel for the backswing and an assurance the follow through will produce straight line ball motion closely approximating the path "PT". Presuming the golfer develops a straight line stroke with a known backswing, the further golfer dependent "force" parameter can be varied in relation to normal playing surfaces and the distance "D" to assure the ball 6 reaches the cup 24.

FIGS. 8 and 9 depict alternative constructions of locating tees 44 and 46 which can be adapted into a trainer. The tee 44 provides an aperture 48 having a counter bored area 50. A pair of inclined surfaces 52 and 54 extend into the body 56 of the trainer. A ball 6 can thus be positioned from either side of the trainer.

In lieu of an enlarged aperture 24, which can partially interrupt the forward movement of a ball 6, the counter bore area 50 partially recesses the ball 6. The counter bore 50 facilitates locating of the ball to the tee 44, yet provides a smooth rolling release from the aperture 48, provided the amount of recess is not overly great.

The tee construction 46, in turn, provides an aperture 58 which is positioned adjacent to a single inclined surface 60 within a body 62 of the trainer. A number of protrusions 62 extend from the rolling surface of the trainer adjacent to the aperture 58. Like the groove 28, the protrusions 62 restrict and direct movement of the ball 6 to the aperture 58 during the teeing operation. That is, upon raising the ball 6, to the rolling surface 8, should the ball not immediately locate to the aperture 58, the protrusions 62 prevent the ball from falling off the rolling surface.

Figure 10:
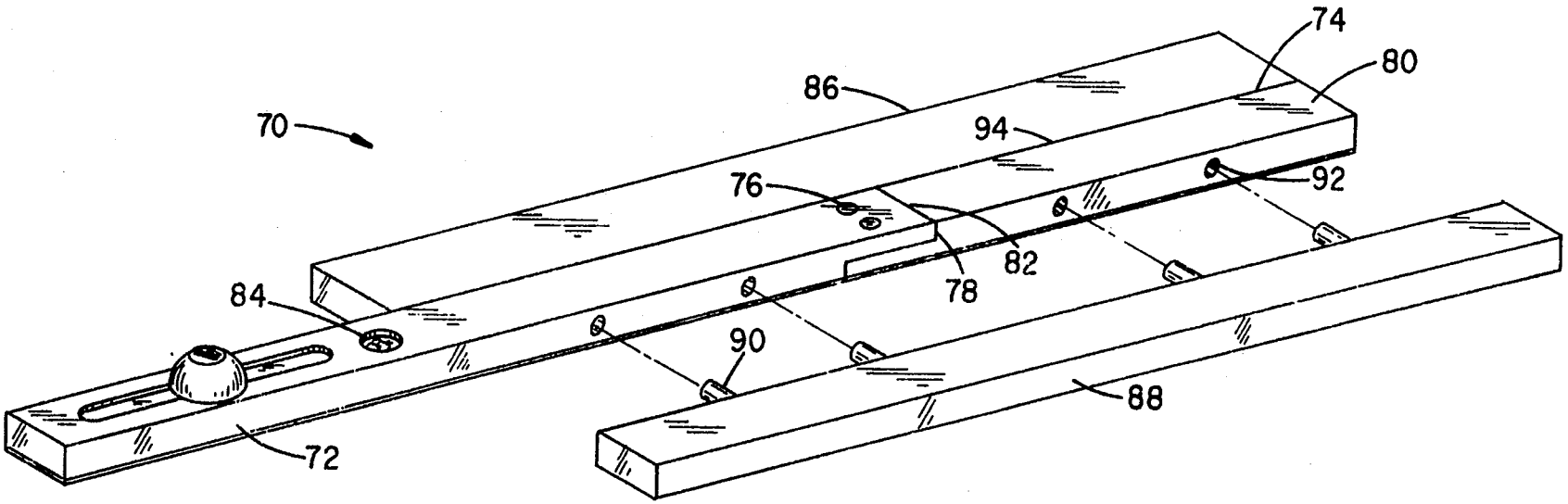
FIG. 10 is a perspective view of a multi-section trainer.

As a further alternative construction and although the dimensions of the trainer 2 can be directly varied, certain practical limits exist in relation to normal shipping and packaging requirements. FIG. 10 therefore depicts a multi-section assembly 70 having axially alignable section pieces 72 and 74. The sections 72, 74 latch to one another at interlock pins 76 and an overlapping joint 78 to provide an essentially seamless rolling surface 80. Trainer lengths of five to eight feet or more are thereby attainable, if desired. Although a seam 82 is created, provided certain tolerances are maintained, the seam will not affect ball roll due to its distal positioning in relation to the tee 84. In lieu of a pinned joint, a variety of hinged joints may also be used to couple the sections 72, 74.

Also depicted at FIG. 10 are a pair of side wings 86 and 88, such as might be added to the trainer 70 to provide a widened rolling surface. In such an instance, the wings 86, 88 are secured to the lateral edges of the sections 72, 74. Pinned projections 90 extend from the wings 86, 88 and interlock with apertures 92 in the sections 72 and 74 to again provide a seamless rolling surface. The longitudinal seams 94 are minimized to prevent any affect on ball travel. As proficiency develops, the wings 72, 74 can be removed.

While the invention has been described with respect to various presently preferred constructions and considered modifications and improvements thereto, still other constructions may be suggested to those skilled in the art. The scope of the invention should be interpreted to include all those equivalent embodiments within the spirit and scope of the following appended claims.

What is claimed is:

1. A golf stroke training device comprising:

a) an elongated body having a bottom, a planar rolling surface and a plurality of sidewalls extending between said bottom and rolling surface, wherein said rolling surface includes a plurality of graduated indicia indicative of ball travel, and wherein said rolling surface permits an uninterrupted rolling action of a golf ball forward of a tee position thereon;

b) a depression at the rolling surface defining said tee position for a golf ball; and c) limit means for obstructing the backstroke of a golf club head, wherein said limit means includes a stop member projecting above said rolling surface a distance within the travel path of a club head and adjustment means for selectively positioning the stop member along said body to obstruct head movement aft of the tee position.

2. Apparatus as set forth in claim 1 wherein said bottom includes an elastomer cover whereby a non-slip interface is obtained with a support surface.

3. Apparatus as set forth in claim 1 including at least one channel extending from one of said sidewalls to said rolling surface in proximity to the tee position, whereby a ball can be directed along said channel to the tee position.

4. Apparatus as set forth in claim 3 wherein said body includes a first channel in said rolling surface aft of the tee position, wherein said stop member comprises an elastomer bumper and means for compressively securing the stop member to said first channel.

5. Apparatus as set forth in claim 4 wherein said bumper includes a first fastener slidably mounted within said first channel and which engages a second fastener mounted within a second channel, and wherein said second channel extends internal to said body and communicates with said first channel.

6. Apparatus as set forth in claim 3 wherein said rolling surface includes a plurality of raised protrusions bordering said tee position and cooperating with said channel to guide a ball onto the tee position.

7. Apparatus as set forth in claim 1 wherein said depression comprises a counter bored aperture.

8. Apparatus as set forth in claim 1 wherein said body comprises a plurality of planar sections and means for non-permanently attaching said sections to one another.

9. Apparatus as set forth in claim 8 wherein ones of said sections align end-to-end and wherein others of sections align along adjacent lateral sidewalls.

10. A golf stroke training device comprising:

a) an elongated body having a bottom, a planar rolling surface and a plurality of sidewalls extending between said bottom and rolling surface, wherein said rolling surface includes a plurality of graduated indicia indicative of ball travel;

b) a depression at the rolling surface defining a tee position for a golf ball; and c) means including a channel in said rolling surface aft of said tee position and a stop member selectively restrained long said channel and protecting above said rolling surface a distance within the travel path of a club head for obstructing movement of a club head aft of the tee position.

11. Apparatus as set forth in claim 10 including a channel extending from a region of one of said sidewalls and communicating with said depression, whereby a golf ball is directable along said channel to said tee position.

12. Apparatus as set forth in claim 10 wherein said body comprises a plurality of planar sections and means for non-permanently attaching said sections to one another.

13. A golf stroke training device comprising:

a) an elongated body having a bottom, a planar rolling surface and a plurality of sidewalls extending between said bottom and rolling surface, wherein said rolling surface includes a plurality of graduated indicia indicative of ball travel;

b) a depression at the rolling surface defining a tee position for supporting a golf ball;

c) means including a channel in said rolling surface aft of said tee position and a stop member selectively restrained along said channel and projecting above said rolling surface a distance within the travel path of a club head for obstructing movement of a golf club head aft of the tee position; and d) at least one channel extending from one of said sidewalls to said rolling surface in proximity to the tee position and means protruding above said rolling surface and bordering said tee position for guiding a ball onto the tee position, without rolling off the rolling surface.

14. Apparatus as set forth in claim 13 wherein said body comprises a plurality of planar sections, wherein ones of said sections align end-to-end, and wherein others of sections align along adjacent lateral sidewalls and means for non-permanently attaching said sections to one another.

15. Apparatus as set forth in claim 13 wherein said body comprises a plurality of planar sections and means for non-permanently attaching said sections to one another.

* * * * *